US005983782A

United States Patent [19]

Lebrun et al.

[11] Patent Number: 5,983,782

[45] Date of Patent: Nov. 16, 1999

[54] ROTARY ACTUATOR WITH HOLE-IN-THE-WALL FOR FAIL SAFE

[75] Inventors: Ivan P. Lebrun, Granger, Ind.; George S. Wieger, Niles, Mich.

[73] Assignee: AlliedSignal Inc., Morristown, N.J.

[21] Appl. No.: 09/131,157

[22] Filed: Aug. 7, 1998

[51] Int. Cl.[6] ..... F01C 9/00

[52] U.S. Cl. ..... 92/122; 92/125; 60/403

[58] Field of Search ..... 60/403; 92/121, 92/122, 125

[56] References Cited

U.S. PATENT DOCUMENTS

| | | | |
|---|---|---|---|
| 2,972,338 | 2/1961 | Lloyd | 92/122 X |
| 3,053,236 | 9/1962 | Self et al. | 92/122 X |
| 3,327,592 | 6/1967 | Wilkinson | 92/122 |
| 4,474,105 | 10/1984 | Eicher et al. | 92/122 |
| 4,475,738 | 10/1984 | Eicher et al. | 92/122 X |
| 4,527,461 | 7/1985 | Ogura | 92/122 X |

*Primary Examiner*—Hoang Nguyen
*Attorney, Agent, or Firm*—Larry J. Palguta; Robert Desmond

[57] ABSTRACT

A fluid powered rotary actuator (10) having a stator (13) and a rotor (15) journalled with limited rotary motion within the stator includes at least one arcuate chamber defined between the rotor and stator and has an angularly movable vane (16) fixed to the rotor. There is a seal member (21, 23) at the vane for slidingly sealing a cylindrical sidewall surface of the stator thereby subdividing the arcuate chamber into two variable volume subchambers (25, 29; 27, 31). Pressurized fluid is ported selectively to one of the subchambers while a fluid egress path for fluid from the other of the subchambers allows the rotor to move angularly within the stator. There is a fail-safe aperture (22) in the cylindrical stator surface in a region traversed by the seal member and for conveying fluid from a selected one of the subchambers, as determined by the position of the vane, and a fail safe valve (24) coupled to and normally blocking the egress of fluid from a subchamber through the aperture (22). The fail-safe valve (24) is energized upon the occurrence of a malfunction to allow fluid flow from the subchamber through the aperture (22). The fail-safe valve (24) may further provide a pressurized fluid path (41, 45) to both subchambers with a fluid return path being provided by through the aperture (22) and fail-safe valve 24 upon the occurrence of a malfunction causing the rotor (15) to move to a neutral position upon occurrence of a malfunction.

18 Claims, 4 Drawing Sheets

ROTARY ACTUATOR WITH HOLE-IN-THE-WALL FOR FAIL SAFE

The present invention relates generally to fluid powered actuators and more particularly to a technique for causing a rotary actuator to "fail safe", that is, upon a system malfunction, to disable or interrupt operation of the actuator and to position it in a predetermined position.

It is known to provide a hole-in-the-wall type of fail safe arrangement in a linear actuator, e.g., of the type having a piston reciprocable along a cylindrical axis, to vent the powering fluid to a fluid return line upon detecting a system malfunction. Typically, a fail safe valve is opened by a sensing circuit that detects a problem somewhere in the system and causes fluid to be dumped from the high pressure chambers to cause the piston to fail or stop at a predetermined stroke position. This prevents the actuator from going full extension or retraction which could cause damage if another part of the system has failed. These linear fail safe arrangements work reasonably at modest fluid operating pressures, for example, hydraulic pressures on the order of 1,500 psi. Experience with linear actuators indicates that operation at higher pressures such as 4,000 psi. causes unacceptably high wear rates to plastic seals in the vicinity of the hole-in-the-wall. While some of this wear may be caused by the mechanical rubbing of the two movable parts, most is errosion caused by the fluid leaking past the seal at the point of least resistance, that is, where the hole effectively reduces the seal contact area. While we are not aware of any attempts to incorporate the hole-in-the-wall type of fail safe arrangement into rotary fluid powered actuators, it is believed such attempts would only exacerbate the wear problem.

It is desirable to provide a fail safe hole-in-the-wall relief port and seal arrangement in a fluidic actuator which is wear and erosion resistant, particularly at higher actuator pressures, and to do so without appreciably increasing the size or weight of the actuator. It is also highly desirable to provide such a fail safe arrangement in a rotary fluid powered actuator. It is also highly desirable to achieve a hole-in-the-wall fail safe arrangement in a rotary fluid powered actuator which is acting upon a constantly present, variable load or reaction force.

The present invention provides solutions to the above problems by providing a fluid powered rotary actuator having a stator with a rotor journalled with limited rotary motion therein. There is at least one arcuate chamber defined between the rotor and stator and an angularly movable vane is fixed to either the rotor or the stator. This vane includes a seal member for slidingly sealing with the other of the rotor or stator to subdivide the arcuate chamber into two variable volume subchambers. An fluidic circuit selectively ports pressurized fluid to one of the subchambers and simultaneously provides an egress path for fluid from the other of the subchambers. This fluid flow causes the rotor to move angularly within the stator. The rotor stops moving when the pressure differential across its vanes balances the torque imposed by the load on the actuator. An aperture in either the rotor or the stator in a region traversed by the seal member provides a fluid flow path to and from a selected one of the subchambers as determined by the position of the vane. A high wear resistance metal seal inset is located within the seal member at a location to pass over and temporarily sealingly cover the aperture as the vane moves past the aperture. This seal inset is a generally H-shaped metal inset located at the surface of the seal member with the opposed legs of the H extending generally parallel to the chamber cylindrical axis and with the crossmember of the H positioned to pass over and temporarily sealingly cover the aperture as the vane moves past the aperture.

In accordance with another form of the invention, a sealing arrangement for slidingly sealing a cylindrical surface has a pair of plastic seals with cylindrical segment surfaces for engaging a surface of a cylindrical movable member and a high wear resistance metallic inset having a central portion located intermediate the pair of plastic seals and two pairs of legs with each pair extending from the central portion and spanning a corresponding one of the plastic seals. The central portion includes a cylindrical segment surface for engaging the surface of the cylindrical movable member.

BRIEF DESCRIPTION OF THE DRAWINGS

Corresponding reference characters indicate corresponding parts throughout the several views of the drawing.

DESCRIPTION OF THE PREFERRED EMBODIMENT

Figure 1:
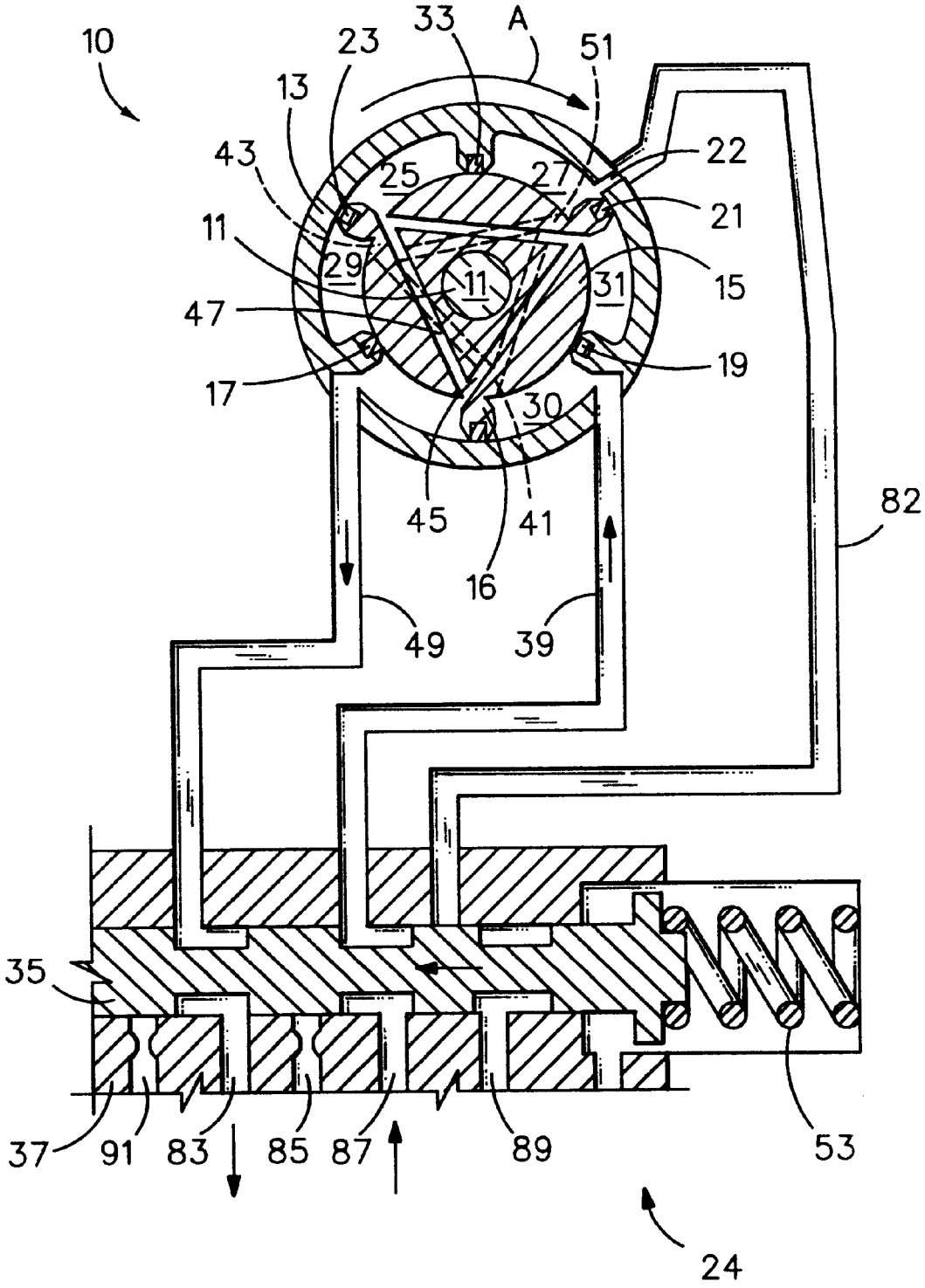
FIG. 1 is a cross-sectional view of a rotary actuator and a portion of a fail safe valve according to the invention in one form.
Figure 2:
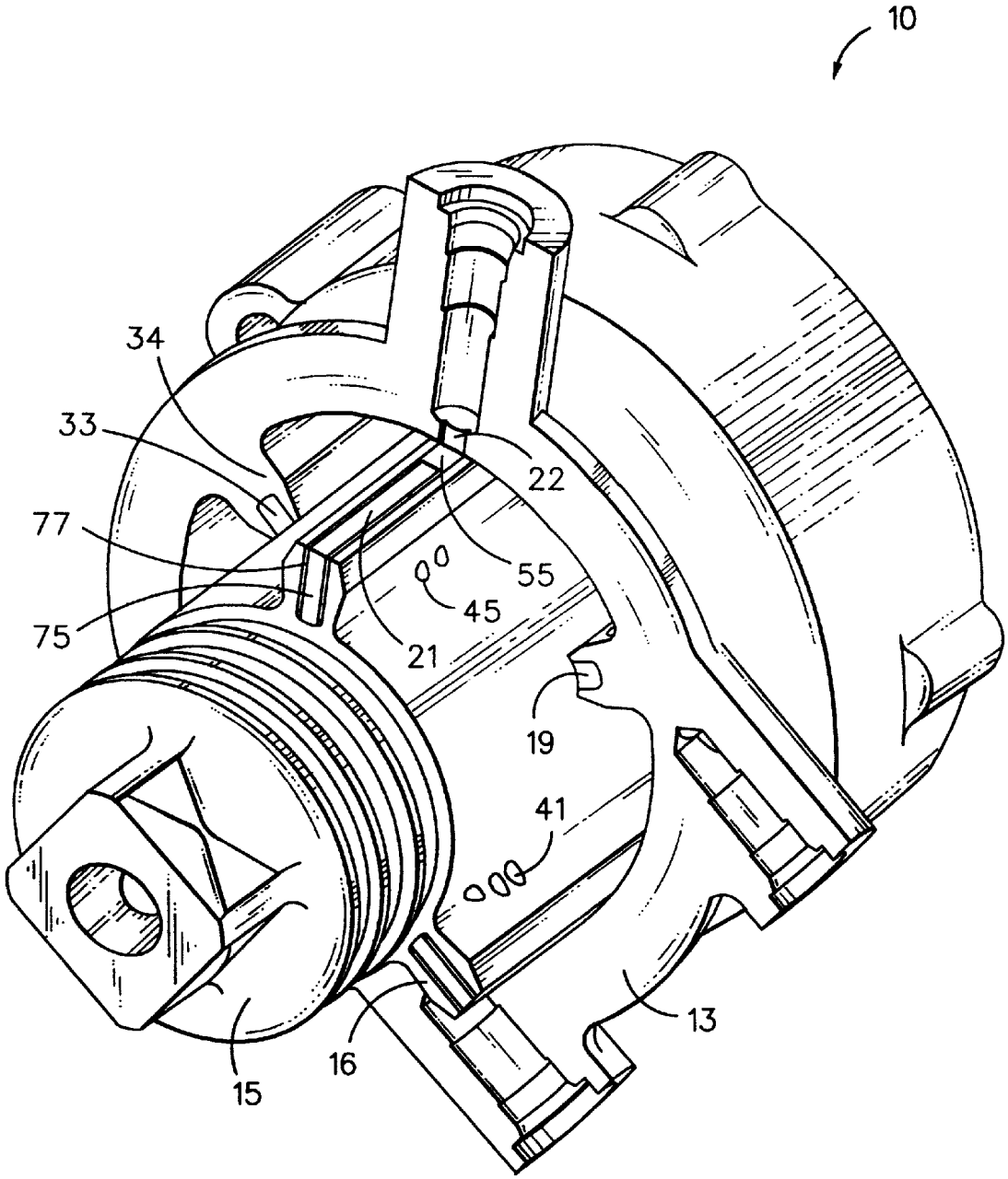
FIG. 2 is a partially broken away isometric view of the rotary actuator of FIG. 1.
Figure 4:
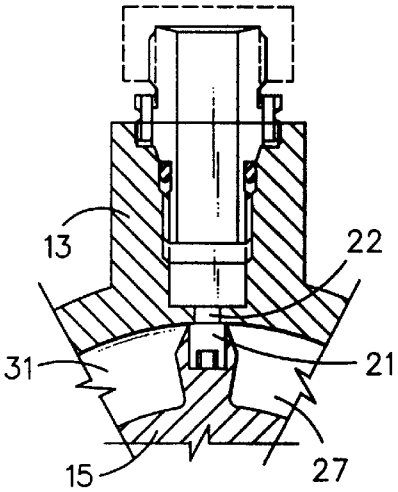
FIG. 4 is a cross-sectional view along line 4—4 of FIG. 3.
Figure 3:
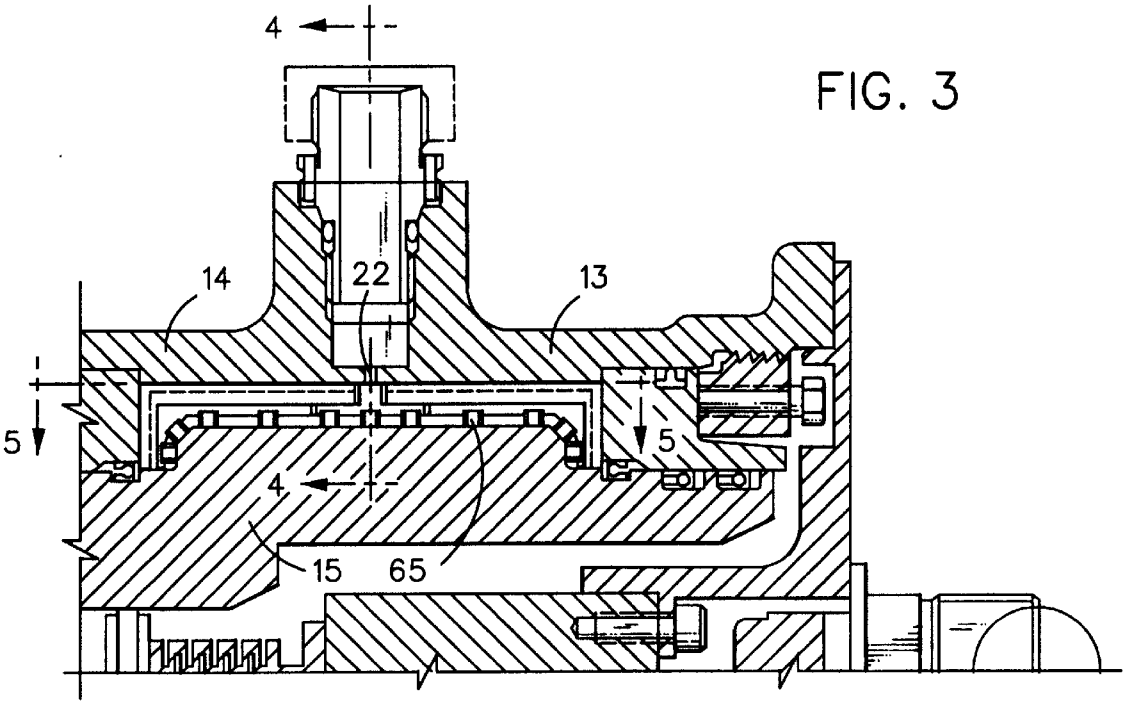
FIG. 3 is a longitudinal cross-sectional view of a portion of the rotary actuator of FIGS. 1 and 2.
Figure 5:
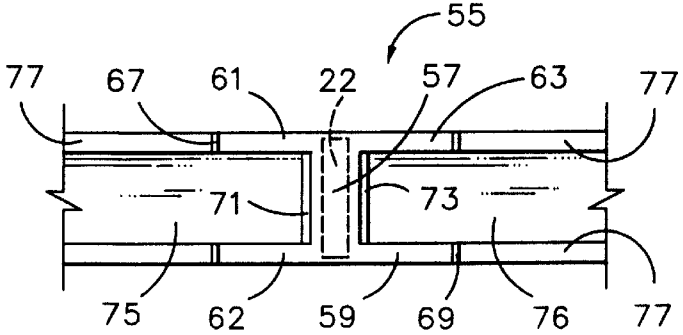
FIG. 5 is a cross-sectional view along line 5—5 of FIG. 3.
Figure 6:
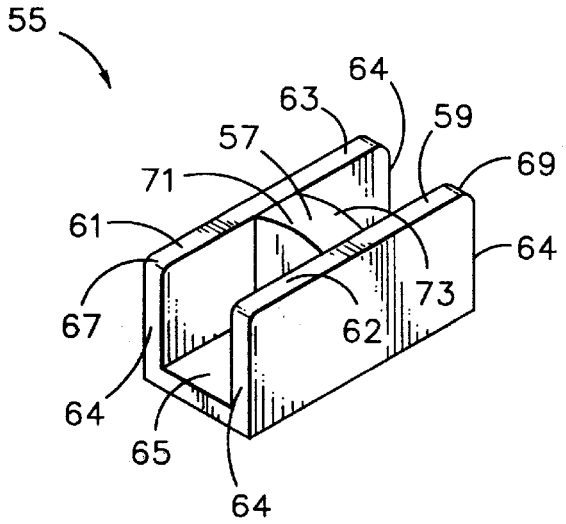
FIG. 6 is an isometric view of the metal seal inset of FIGS. 2–5.
Figure 7:
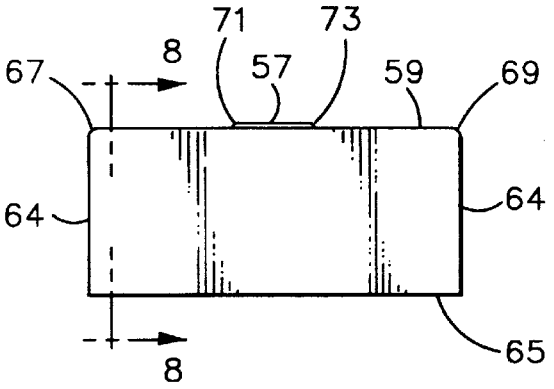
FIG. 7 is a side elevation view of the metal inset of FIG. 6.

Referring first to FIGS. 1 and 2, a fluid powered rotary actuator 10 is illustrated and includes a stator 13 and a rotor 15 which is journalled within the stator and with limited rotary motion. There are three vanes such as 34 fixed to and extending radially inwardly from the stator or housing 13. Similarly, there are three vanes such as 16 fixed to and extending radially outwardly from the rotor 15. The rotor vanes sealingly engage a concave cylindrical sidewall portion of the stator and the stator vanes sealingly engage a convex cylindrical portion of the rotor. The pairs of stator vanes cooperate with the rotor to define three arcuate chambers. Each of the intervening rotor vanes subdivides the corresponding arcuate chamber into two variable volume subchambers such as 25 and 29 or 27 and 31. There is a seal member, such as 17, 19, 21, 23 or 33, on each of the vanes for slidingly sealing the cylindrical sidewall surface of the stator or rotor.

Pressurized fluid may be selectively ported to one of each pair of subchambers from fluid inlet 87, through conduit 39 and into subchamber 27 by way of rotor port 41 and into subchamber 29 by way of rotor port 43. A fluid egress path may be provided for fluid from each of the other of the pairs of subchambers. For example, fluid may exit from subchamber 25, through rotor port 47 and conduit 49 to the fluid return at 83. Similarly, fluid from subchamber 31 may pass through rotor port 45 and conduit 49 to the return 83. The thus described fluid flow would cause the rotor 15 to rotate angularly within the stator 13 in the clockwise direction as indicated by the arrow A.

There is a fail-safe aperture 22 in the cylindrical stator 13 surface within one of the arcuate chambers in a region traversed by the seal member 21 for conveying fluid from a either subchamber 27 or subchamber 31 depending on the position of the vane supporting seal 21. The aperture may be located in an endwall such as 14, in the rotor 15, but is preferably located in the stator concave cylindrical portion or bore. FIG. 1 illustrates an example of a fail safe valve 24 which is coupled to the aperture 22 and which blocks the egress of fluid from a subchamber 27 or 31 through the aperture 22, conduit 82 and outlet 89. Valve 24 is an example of such a controlling system; many other valve designs can be utilized to perform the same or similar functions. Valve 24 has a spool 35 that can be controlled by a solenoid and/or fluid source (not shown) to normally be located in the position illustrated within the valve housing 37. In this position, fluid may flow into either port 83 or port 87 and exit the other of these ports. Port 89 is normally blocked by the spool 35. The fail safe valve is energized upon the occurrence of a malfunction to allow fluid flow from the particular subchamber through the aperture. When a malfunction occurs, the corresponding subchambers of the other two arcuate chambers are also connected to the outlet. For example, if subchamber 27 is connected to outlet 89, so is subchamber 29 by way of rotor port 51 and subchamber 30 by way of rotor port 41.

In some systems, it is desirable that the actuator rotor 15 be placed in a predetermined position when specific types of failures occur. Should such a failure be detected, the solenoid allows spring 53 to force the spool 35 to its extreme leftmost position opening a path from aperture 22 to the outlet port 89. Conduit 39 is opened to inlet 85, and conduit 49 opened to inlet 91. Both sides of the rotor vanes 16 receive supply pressure from inlets 85 and 91 through restricting orifices in the inlets. This causes rotor 15 to move to a position where orifice 22 is partially covered by vane 16 such that the pressure differential across the vane balances the load upon the actuator 10. Thus, the location of aperture 22 determines the final position of the rotor 15.

The actuator may have only one arcuate chamber, but typically three or four arcuate chambers are employed. The angular travel is slightly less (by the thickness of one rotor vane and one stator vane) than 360 degrees divided by the number of arcuate chambers. The aperture 22 is located in a concave sidewall portion of the stator, rotor or endwall intermediate the extremes of the limited rotary motion of the rotor 15 within the stator 13. Because of the interconnecting rotor porting, only one hole-in-the-wall aperture is needed, regardless of the number of arcuate chambers. As noted earlier, the presence of the aperture reduces the area of seal contact causing increased erosion in that region.

Seals such as 17, 19, 23 and 33 are conventional polytetrafluoroethylene seals. The seal 21 is unique and is shown in detail in FIGS. 3–8. This seal member 21 comprises a pair of plastic (typically polytetrafluoroethylene) seals 75 and 76 having cylindrical segment surfaces for engaging the cylindrical sidewall surface of the stator 13. A high wear resistance metallic inset 55 which has a shape reminiscent of a concrete block, but lacking the two endwalls and having a bottom wall 65. The metal inset has a cross member or central portion 57 located, for example, intermediate the pair of plastic seals 75 and 76 and two pairs of legs such as 59 and 63, 61 and 62 each pair extending from the central portion 57, generally parallel to the cylindrical axis of the rotor and spanning a corresponding one of the plastic seals. A pair of plastic back-up members 77 span each plastic seal 75 or 76 and abut respective H leg ends 64 of the inset 55.

Figure 8:
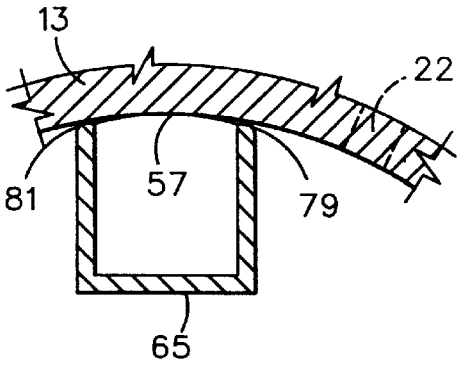
FIG. 8 is a view in cross-section along lines 8—8 of FIG. 7 with a portion of the stator added.

As best seen in FIG. 8, the central portion 57 of inset 55 includes a cylindrical segment surface for engaging the surface of the cylindrical stator 13. The pairs of legs such as 59, 63 and 61, 62 of the H are relieved as shown at 67 and 69 in the regions of the free ends of the H legs. The inset is also relieved near the extremes of the central portion as shown at 79 and 81 to clear the surface of the cylindrical member. The central portion 57 includes similar gentle radii 71 and 73, best seen in FIG. 7. These relieved regions or gradual blending radii gradually separate the inset from the bore of the stator and minimize scoring of that surface.

What is claimed is:

1. A fluid powered rotary actuator, comprising a stator, a rotor journalled with limited rotary motion within the stator, at least one arcuate chamber defined between the rotor and stator; a vane fixed to one of the rotor and stator, the vane including a seal member slidingly sealing engaging the other of the rotor and stator to subdivide the arcuate chamber into two variable volume subchambers, and means for selectively transmitting pressurized fluid to one of the subchambers and simultaneously providing an egress path for fluid from the other of the subchambers to thereby cause the rotor to move angularly within the stator, the improvement comprising:

an aperture in said other of the rotor and stator in a region engaged by the seal member and for communicating fluid with a selected one of the subchambers as determined by the position of the vane;

a high wear resistance seal inset located within the seal member at a location to pass over and temporarily sealingly cover the aperture when relative movement occurs between the rotor and stator.

2. The improvement of claim 1, wherein the seal inset comprises a generally H-shaped metal inset located at the surface of the seal member with opposed legs of the insert extending generally parallel to a cylindrical axis of the chamber and with a cross member of the insert positioned to pass over and temporarily sealingly cover the aperture.

3. The improvement of claim 2, wherein the seal inset is relieved in the regions of free ends of the legs to clear a curved surface of said other of the stator and rotor to thereby minimize scoring of said curved surface.

4. The improvement of claim 2, wherein the stator portion of the arcuate chamber is generally cylindrical and the aperture is located in a concave sidewall portion of the stator intermediate extremes of the limited rotary motion of the rotor within the stator.

5. The improvement of claim 1, wherein the seal member comprises a pair of plastic seals having cylindrical segment surfaces for engaging a cylindrical sidewall surface of the arcuate chamber, and a high wear resistance metallic inset having a cross member located intermediate the pair of plastic seals and two pairs of legs, each pair of legs extending from the cross member and spanning at least a part of a corresponding plastic seal, the central portion including a cylindrical segment surface for engaging the surface of the cylindrical sidewall surface.

6. The improvement of claim 5, further comprising a pair of plastic back-up members spanning each plastic seal and abutting respective legs.

7. A fluid powered rotary actuator and control system, comprising a stator; a rotor journalled with limited rotary motion within the stator, at least one arcuate chamber defined between the rotor and stator, an angularly movable vane fixed to the rotor and including a seal member for slidingly sealing a cylindrical sidewall surface of the stator to subdivide the arcuate chamber into two variable volume subchambers and means for selectively transmitting pressurized fluid to one of the subchambers and simultaneously providing an egress path for fluid from the other of the subchambers to thereby cause the rotor to move angularly within the stator, the improvement comprising:

a fail-safe aperture in the cylindrical sidewall surface in a region traversed by the seal member and for conveying fluid from a selected one of the subchambers as determined by the angular position of the vane; and a fail safe valve coupled to and normally blocking the egress of fluid from a subchamber through the aperture, and energizable upon the occurrence of a malfunction to allow fluid flow from the subchamber through the aperture.

8. The improvement of claim 7, wherein fluid powering the actuator is a hydraulic fluid and the malfunction occurs within an application system containing the control system.

9. The improvement of claim 7, wherein the fail safe valve provides a pressurized fluid path to both subchambers with a fluid return path being provided through the aperture and fail-safe valve upon the occurrence of the malfunction.

10. The improvement of claim 7, further comprising a high wear resistance seal inset located within the seal member at a location to pass over and temporarily sealingly cover the aperture as the vane moves past the aperture.

11. The improvement of claim 10, wherein the seal inset comprises a generally H-shaped metal inset located at a surface of the seal member with opposed legs of the insert extending generally parallel to a cylindrical axis of the chamber and with the crossmember of the insert positioned to pass over and temporarily sealingly cover the aperture as the vane moves past the aperture.

12. The improvement of claim 11, wherein the seal inset is relieved in regions of free ends of the legs to clear a cylindrical surface of the stator and thereby minimize scoring of said cylindrical surface.

13. The improvement of claim 7, wherein said seal member includes a pair of plastic seals having cylindrical segment surfaces for engaging a cylindrical sidewall surface of the arcuate chamber, and a high wear resistance metallic inset having a central portion located intermediate the pair of plastic seals and two pairs of legs, each pair of legs extending from the central portion and spanning at least a part of a corresponding plastic seal, the central portion including a cylindrical segment surface for engaging the surface of the cylindrical sidewall member.

14. The improvement of claim 13, further comprising a pair of plastic back-up members spanning each plastic seal and abutting respective legs.

15. A sealing arrangement for slidingly sealing a cylindrical surface comprising:

a pair of plastic seals having cylindrical segment surfaces for engaging the cylindrical surface of a movable member;

a high wear resistance metallic inset having a cross member located intermediate the pair of plastic seals and two pairs of legs, each pair of legs extending from the cross member and spanning at least a portion of a corresponding plastic seal and, the cross member including a cylindrical segment surface for engaging the surface of the cylindrical surface.

16. The sealing arrangement of claim 15, further comprising a pair of plastic back-up members spanning each plastic seal and abutting respective legs.

17. The sealing arrangement of claim 15, wherein the pairs of legs of the insert extend from the central portion generally parallel to a cylindrical axis of the cylindrical surface and are relieved in regions of free ends of the legs to clear the cylindrical surface and thereby minimize scoring of said surface.

18. The sealing arrangement of claim 15, wherein the pairs of legs of the insert extend from the central portion generally parallel to a cylindrical axis of the cylindrical surface and are relieved in regions of free ends of the legs and near extremes of the central portion to clear the cylindrical surface and thereby minimize scoring of said surface.

* * * * *